US009863684B2

(12) United States Patent
Gomes et al.

(10) Patent No.: US 9,863,684 B2
(45) Date of Patent: Jan. 9, 2018

(54) ICE MAKER WITH PIEZO DIELECTRIC ELASTOMER SENSOR

(71) Applicant: Whirlpool Corporation, Benton Harbor, MI (US)

(72) Inventors: Alberto R. Gomes, Cumming, GA (US); Yen-Hsi Lin, Saint Joseph, MI (US); Andrew M. Tenbarge, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 542 days.

(21) Appl. No.: 14/476,796

(22) Filed: Sep. 4, 2014

(65) Prior Publication Data

US 2015/0059394 A1 Mar. 5, 2015

Related U.S. Application Data

(60) Provisional application No. 61/873,911, filed on Sep. 5, 2013.

(51) Int. Cl.
*F25C 5/06* (2006.01)

(52) U.S. Cl.
CPC ..... *F25C 5/06* (2013.01); *F25C 2600/04* (2013.01); *F25C 2700/00* (2013.01)

(58) Field of Classification Search
CPC ..... F25C 5/06; F25C 2600/04; F25C 2700/00
USPC ..... 62/353
See application file for complete search history.

(56) References Cited

U.S. PATENT DOCUMENTS 3,842,993 A * 10/1974 Hagen ..... B65G 65/42 62/344
3,913,350 A * 10/1975 Alvarez ..... F25C 1/04 62/353
5,109,651 A * 5/1992 Stuart ..... F25C 5/002 53/167
5,272,400 A * 12/1993 Goldberg et al. ..... H02K 3/04 310/10
6,062,426 A * 5/2000 Bartholmey et al. ..... B67B 7/00 222/1
7,131,280 B2 * 11/2006 Voglewede ..... F25C 1/246 62/233
8,281,611 B2 * 10/2012 Davis ..... F25C 1/04 62/344

OTHER PUBLICATIONS

Azo Sensors, "Piezoelectric Sensors and Strain Gauge-based Force Transducers", Aug. 20, 2013, http://www.azosensors.com/article.aspx?ArticleID=281.*

(Continued)

*Primary Examiner* — Cassey D Bauer

(57) ABSTRACT

An ice maker includes, among other things, an ice cube mold, an ice cube remover and a force sensor comprising a piezo dielectric elastomer (PDE). The ice cube mold has at least one cavity for receiving liquid. The ice cube remover is configured to apply a removal force to either the mold or an ice cube. The force sensor is provided on either the mold or the remover and provides an output indicative of the removal force. Upon the removal of an ice cube from the cavity, the ice cube remover applies a removal force to the mold or the ice cube to effect the removal of the ice cube from the cavity and the force sensor outputs a signal indicative of the removal force.

11 Claims, 6 Drawing Sheets

(56) References Cited

OTHER PUBLICATIONS

O'Halloran et al, "A review on dielectric elastomer actuators, technology, applications, and challenges", Jul. 2008, http://aip.scitation.org/doi/full/10.1063/1.2981642.*

Elsevier, "Dielectric Elastomers as Electromechanical Transducers", Jan. 22, 2008, https://www.elsevier.com/books/dielectric-elastomers-as-electromechanical-transducers/carpi/978-0-08-047488-5.*

Sharpe, "Springer Handbook of Experimental Solid Mechanics", 2008, p. 322, https://www.bookdepository.com/Springer-Handbook-Experimental-Solid-Mechanics-William-N-Sharpe-Jr/9780387268835.*

* cited by examiner

ICE MAKER WITH PIEZO DIELECTRIC ELASTOMER SENSOR

CROSS-REFERENCE TO RELATED APPLICATION

This Application claims priority to and the benefit of U.S. Provisional Patent Application Ser. No. 61/873,911, filed on Sep. 5, 2013, the entire disclosure of which is hereby incorporated by reference.

BACKGROUND OF THE INVENTION

The freezer compartment of a residential refrigerator may include an automatic ice maker. An ice maker typically includes an ice mold for receiving water and forming ice cubes while the water freezes. Once the molded ice cubes are frozen, a motor either twists the ice mold or rotates an arm to eject the ice cubes out of the mold. The ejected ice cubes may then collect in a bin until dispensed from the freezer compartment.

SUMMARY OF THE INVENTION

The invention relates to an ice maker comprising: an ice cube mold having at least one cavity for receiving liquid; an ice cube remover configured to apply a removal force to at least one of the mold and ice cube; a force sensor comprising a piezo dielectric elastomer (PDE) provided on one of the mold and remover and providing an output indicative of the removal force; wherein upon the removal of an ice cube from the cavity, the ice cube remover applies a removal force to one of the mold and ice cube to effect the removal of the ice cube from the cavity and the force sensor outputs a signal indicative of the removal force.

DESCRIPTION OF EMBODIMENTS OF THE INVENTION

Figure 1:
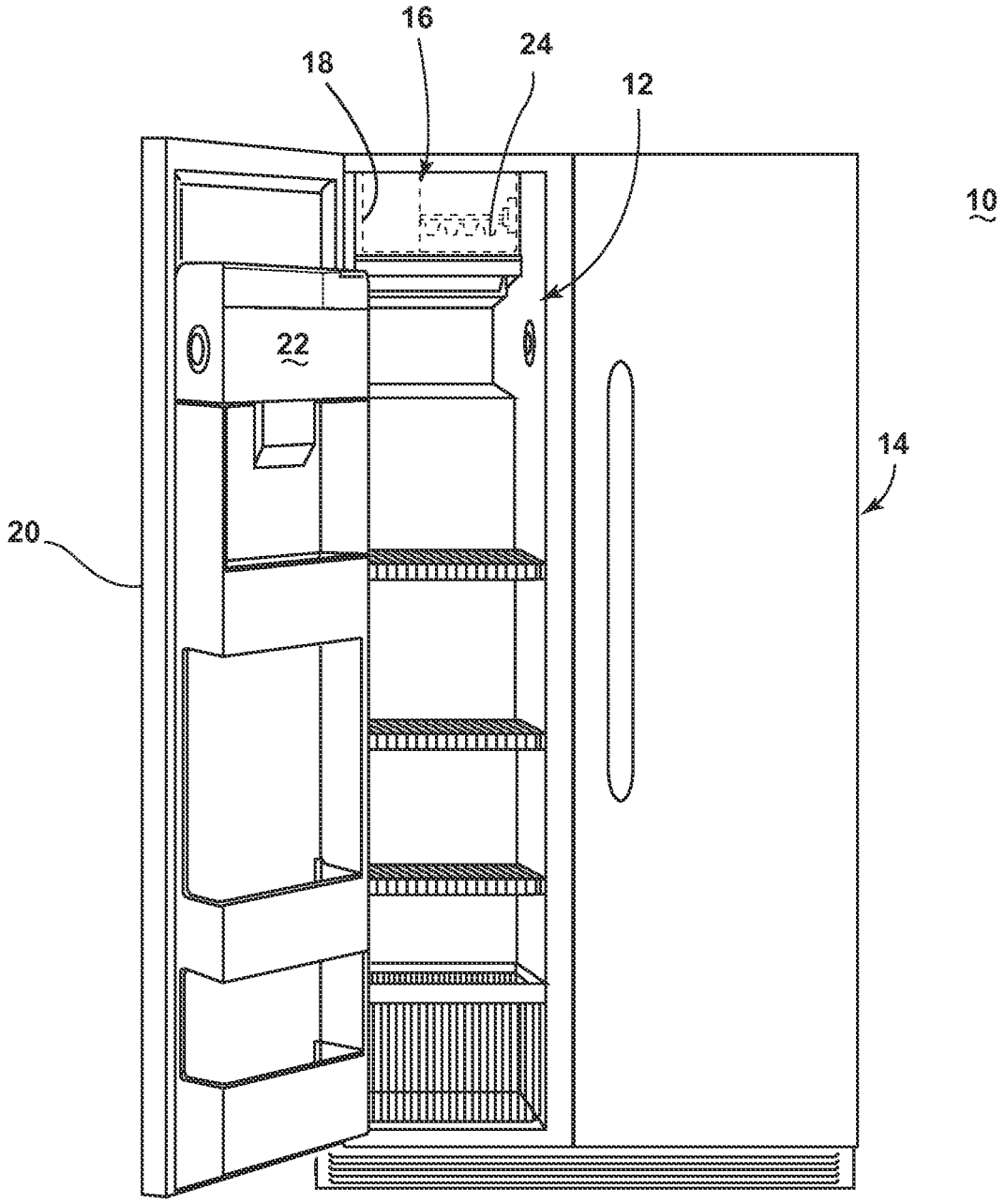
FIG. 1 is a front view of a refrigerator with an ice maker according to an embodiment of the invention.

Three basic configurations of refrigerators with a freezer compartment include a side-by-side configuration, a top freezer configuration and a bottom freezer configuration. As shown in FIG. 1, a refrigerator 10 in a side-by-side configuration has a freezer compartment 12 located next to a refrigerated compartment 14. By contrast, a top freezer configuration has a freezer compartment located above the refrigerated compartment and the bottom freezer configuration has a freezer compartment located beneath the refrigerated compartment. Generally, an ice maker 16 and an ice storage bin 22 are located in the freezer compartment 12 of the refrigerator 10. However, hybrid combinations of the basic configurations may include a French door configuration where the ice maker 16 may be included in the refrigerated compartment.

The ice maker 16 may mount to the wall 18 of the freezer compartment 12. Alternatively, the ice maker 16 may mount to the door 20 of the freezer compartment 12 or attach to a base 24 that in turn may mount to the wall 18 or door 20 of the freezer compartment 12. The ice storage bin 22 is configured to receive and then store ice ejected from the ice maker 16 and may be positioned on the door 20 or beneath the ice maker 16 in the freezer compartment 12.

Figure 2:
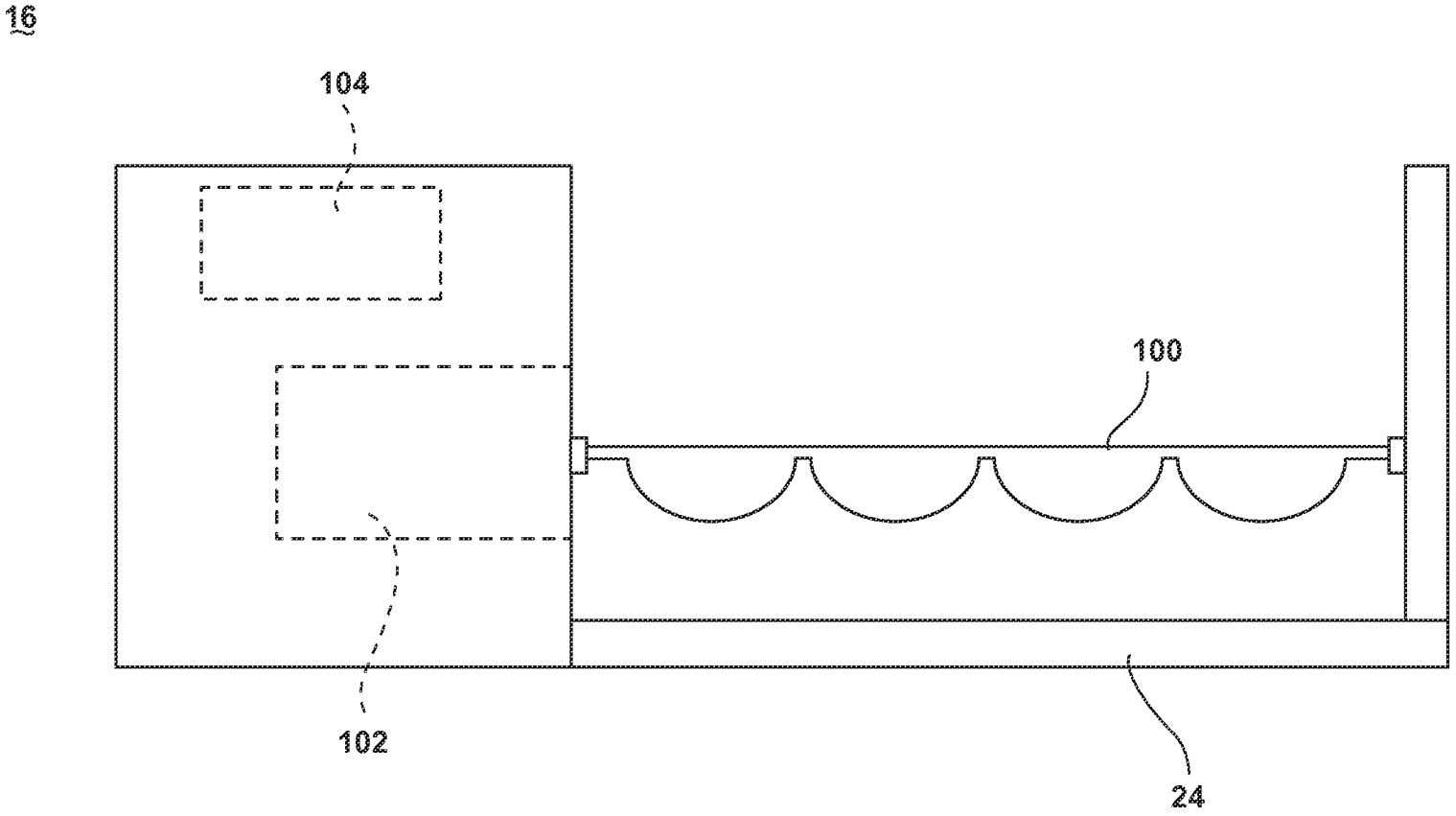
FIG. 2 is a front view of an ice maker that twists an ice cube mold to remove ice cubes according to an embodiment of the invention.

Referring now to FIG. 2, the ice maker 16 may further include an ice cube mold 100 for receiving water and forming ice cubes, a motor 102 for delivering torque to remove the ice cubes during the ice harvesting process and a controller 104. The controller 104 may control aspects of the ice harvesting process including when and to what level application of motor torque to remove ice cubes is required. The ice maker 16 may be configured as a twist ice maker to remove ice cubes by twisting the ice cube mold 100. Alternatively, as described below, the ice maker may be configured to remove ice cubes by rotating the fingers of a rake through the portions of the ice cube mold containing the ice cubes.

Figure 3:
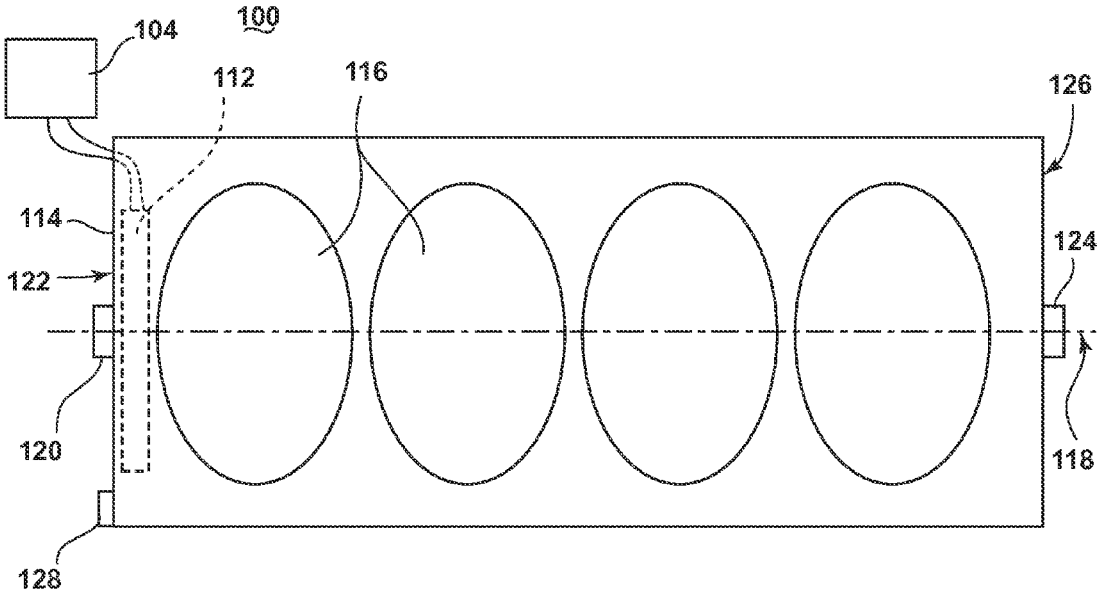
FIG. 3 is an overhead view of an ice cube mold for an ice maker with a force sensor positioned along the side edge of the mold according to an embodiment of the invention.

Referring now to FIG. 3, an ice cube mold 100 for a twist ice maker with a force sensor 112 positioned along the side edge 114 of the ice cube mold 100 may now be described. The ice cube mold 100 may have one or more cavities 116 for receiving liquid. For a twist ice maker, the ice cube mold 100 may be rotatably mounted to a drive mechanism that may apply a removal force to the ice cubes in the flexible ice cube mold 100. For example, the ice cube mold 100 of a twist ice maker may be supported for rotation about a longitudinal axis 118 by a driver coupling 120 at one end 122 of the mold and a suitable shaft 124 at the opposite end 126 of the mold. An automatically controlled motor 102 may be configured to apply a torque to the driver coupling 120 to effect rotation.

During an ice harvesting operation, rotation of one end 122 of the ice cube mold 100 without concurrent rotation of the opposite end 126 may effect a twisting of the ice cube mold 100 to a level that frees previously formed ice cubes in the cavities 116. When the ice cube mold 100 reaches a sufficient angle of twist to effect full ice extraction, an element 128, such as a boss located on the ice cube mold 100, may activate a momentary switch by physical contact. The element 128 may be located at any point on the ice cube mold 100 where the deflection of the element 128 correlates to the overall twisting of the ice cube mold 100. For example, as shown in FIG. 3, the element 128 may be placed along the end 122 of the mold nearest to the driver coupling 120, though other positions on the mold may be used.

Automatic ice makers do not typically include a feedback mechanism to control the amount of torque generated by the motor 102 for extracting ice cubes from the ice cube mold 100. Excess friction between one or more of the ice cubes and the cavities 116 in the ice cube mold 100 may prevent an ice cube from ejecting from the ice cube mold 100 without the addition of more force. Consequently, elements of the ice maker that are subject to the application of the additional force may experience fatigue and failure.

To provide feedback indicative of the level of force being applied to various elements of the ice maker, particularly to the elements actuated during an ice cube harvesting operation, a sensor 112 capable of outputting an electrical signal indicative of an applied mechanical force may be provided. Generally, sensors that convert mechanical force into electrical signals are known as electromechanical transducers. A force sensor for elements of an ice maker may be subject to large angles of deflection and high values of strain. Namely, a sufficient angle of twist for an ice cube mold to induce a level of torsion that will eject ice cubes typically ranges from 20 to 40 degrees. Due to these operating characteristics, a particularly relevant type of electromechanical transducer for use as a force sensor is a piezo dielectric elastomer (PDE).

PDEs are a type of dielectric electroactive polymer (DEP). Generally, DEPs are materials in which actuation is caused by electrostatic forces between two electrodes which squeeze the polymer. PDEs are capable of very high strains and are fundamentally a capacitor that changes capacitance when a voltage is applied by allowing the polymer to compress in thickness and expand in area in response to an electric field. DEPs require no power to keep the actuator at a given position. Because of the highly flexible nature of DEP, PDEs may be used as sensors for measuring an applied force in an environment where significant deformation may occur that would render conventional transducers inoperative.

With the use of PDE force sensors, the applied motor torque may be monitored and managed in a controlled fashion to aid in the ice harvesting process. As shown in FIG. 3, implementing a PDE as a force sensor 112 on the ice cube mold 100 may provide a feedback mechanism for the controller 104 to detect excessive twisting of the ice cube mold 100 and prevent early fatigue. The force sensor 112 may induce a voltage in response to the degree of deformation of the ice cube mold 10 along the area of the ice cube mold 10 in contact with the force sensor 112. Placing the force sensor 112 in an area where the ice cube mold 100 has an elevated risk of fracturing may provide actionable feedback for determining when a particular area of the ice cube mold 100 is excessively twisted. Therefore, conventional actuation of a momentary switch may provide a measure of detection for achieving sufficient twist to release the ice cubes and the PDE force sensor 112 may provide an additional measure to help prevent excessive twisting in a specific area prone to fatigue.

Figure 4:
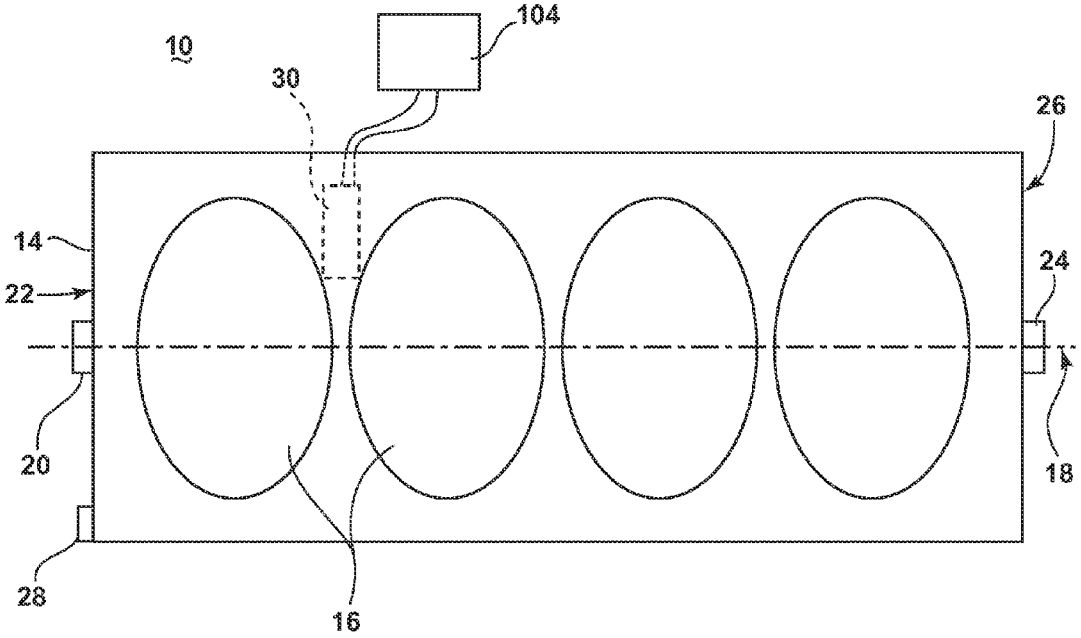
FIG. 4 is an overhead view of an ice cube mold for an ice maker with a force sensor positioned between cavities of the mold according to an embodiment of the invention.

While the force sensor 112 as shown in FIG. 3 is placed along the side edge 114 of the ice cube mold 100 proximal to the driver coupling 120 and orthogonal to the longitudinal axis 118, other configurations are contemplated. Non-uniform deformation of the ice cube mold 100 in response to an applied removal force may result from a number of diverse causes that may have different effects on different areas of the ice cube mold 100. For example, calcium deposits forming on the ice cube mold 100 may cause the ice cubes to stick inside the ice cube mold 100 during the ice harvesting process. However, the extent to which the ice cubes stick may vary between cavities 116 resulting in variable levels of strain between each cavity 116. Consequently, as shown in FIG. 4, the PDE force sensor 130 may be placed between two of the cavities 116. Multiple twist sensors 112 may be implemented for monitoring multiple high risk areas. For example, a force sensor 112 may be placed between each pair of cavities 116. Alternatively, the PDE force sensor 112 may be oriented at an angle relative to the longitudinal axis 118. Preferably, the force sensor 112 may be located at any position and orientation on the ice cube mold 100 where excessive twisting may occur as a result of a non-uniform deformation of the ice cube mold 100.

The ice cube mold 100 may be formed of any material that is both flexible and has a thermal conductivity conducive to forming ice. For example, aluminum has a thermal conductivity much higher than water and therefore aids in producing ice quickly. Other materials contemplated for the ice cube mold generally include plastics and metals. The material used for the ice cube mold and its corresponding properties may directly affect the preferred placement of the one or more force sensors. Other factors may include the shape and relative placement of the cavities of the ice cube mold 100.

Figure 5:
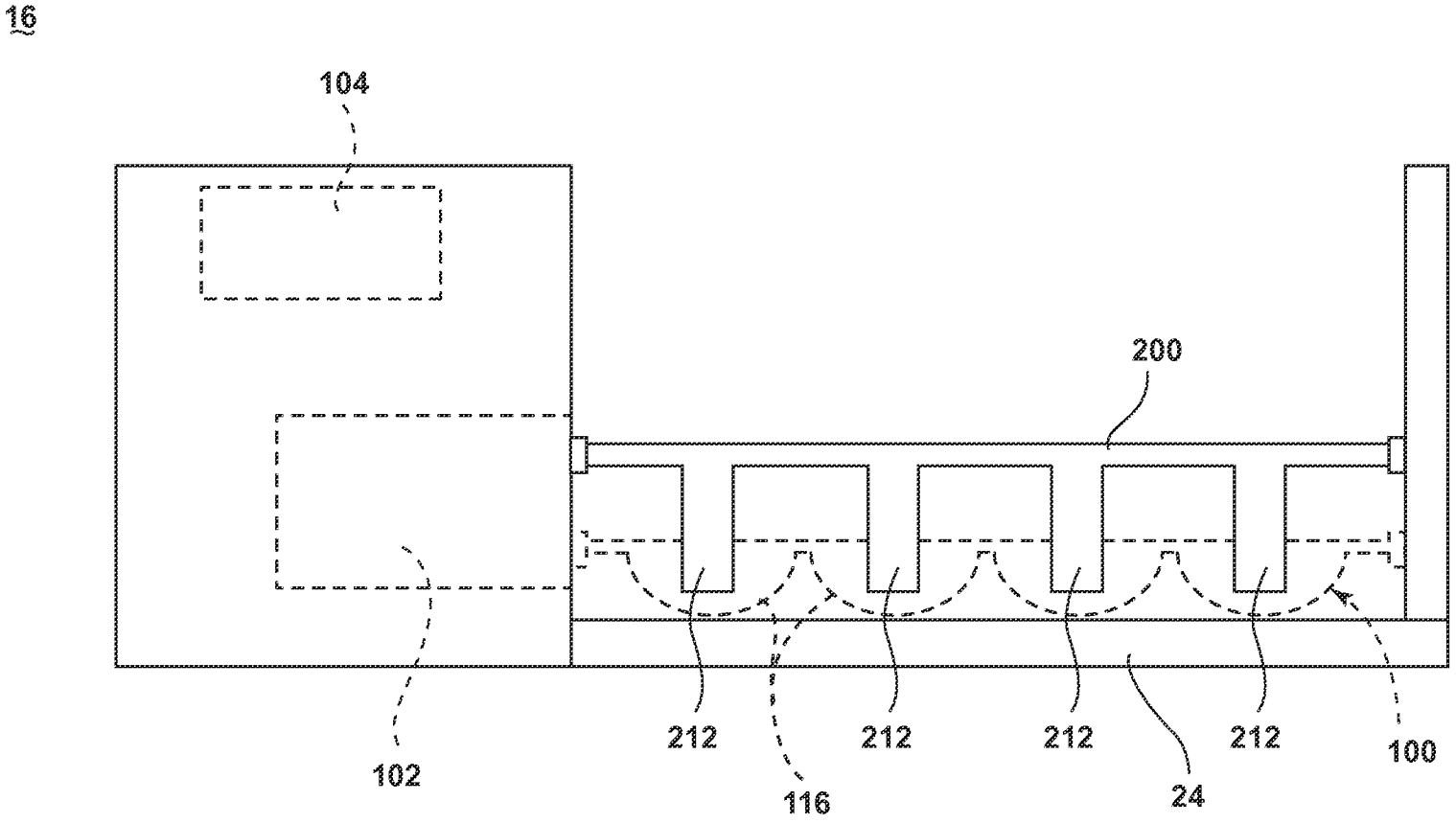
FIG. 5 is a front view of an ice maker that twists a rake to remove ice cubes from an ice cube mold according to an embodiment of the invention.

Referring now to FIG. 5, as an alternative to twisting the ice cube mold 100, the ice maker 16 previously described in FIG. 2 may further include a rake 200 whereby the controller 104 may direct the motor 102 to rotate the rake 200. To expel ice cubes from the ice cube mold 100, each finger 212 of the rake 200 is rotatable through a cavity 116 of the ice cube mold 100.

Figure 6:
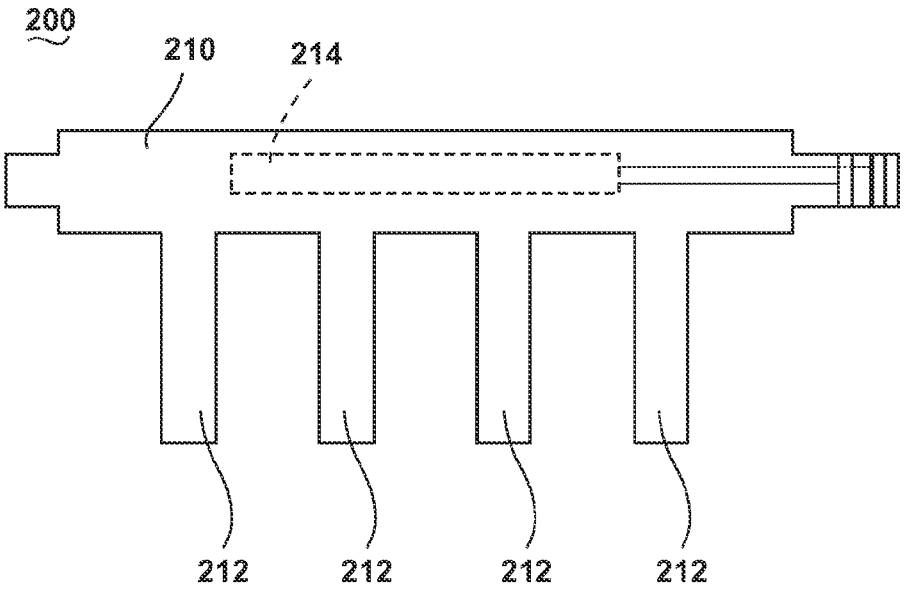
FIG. 6 is side view of a rake for ice cube removal with a force sensor positioned along the shaft of the rake according to an embodiment of the invention.

As seen in FIG. 6, the rake 200 may further include a rotatable shaft 210 and at least one finger 212 extending from the shaft 210. The rotatable shaft 210 may be coupled to the motor 202 such that torque may be applied to the shaft 210 to effect rotation during an ice harvesting process.

During an ice harvesting process with a rotating rake 200, a heating element connected to the ice cube mold 100 may apply heat to the cavities 116. Then, the rake 200 may rotate the fingers 212 through the briefly heated cavities 116 and effect removal of the ice cubes. Similar to the twisting of the ice cube mold 100, the process of rotating the fingers 212 of the rake 200 through the cavities 116 may apply an excessive level of force to the ice cubes causing either the ice cubes to break or elements of the rake 200 to fatigue. Additionally, undesirable levels of noise may occur during the ice harvesting process. By implementing a PDE force sensor 214 on the rake 200 in a manner similar to that described above for the ice cube mold 100, a controlled application of torque from the motor 102 to rotate the rake 200 may mitigate deleterious effects including broken ice, rake fatigue and excess noise.

For example, as shown in FIG. 6, placing the PDE force sensor 214 directly on the rotatable shaft 210 of the rake 200, the applied motor force may be monitored and limited until the bond between the ice cubes and the cavities 116 is broken. In this way, a more gentle ice harvest may mitigate the previously described negative effects. While the PDE force sensor 214 may extend along the rotatable shaft 210 for a distance at least as great as two adjacent fingers 212, other lengths may be contemplated. For example, the PDE force sensor may extend the entire length of the rotatable shaft 210. Similar to placing the PDE force sensor on the ice cube mold 100, the particular length of the PDE sensor implemented on the rake's shaft 210 may preferably be selected to measure the force and deflection on a part of the rake 200 deemed most likely to fatigue. In this configuration, the PDE force sensor 214 may detect an angle of twist greater than 2 degrees along the rotatable shaft 210 indicative of potentially excess motor torque or an impacted ice cube.

Figure 7:
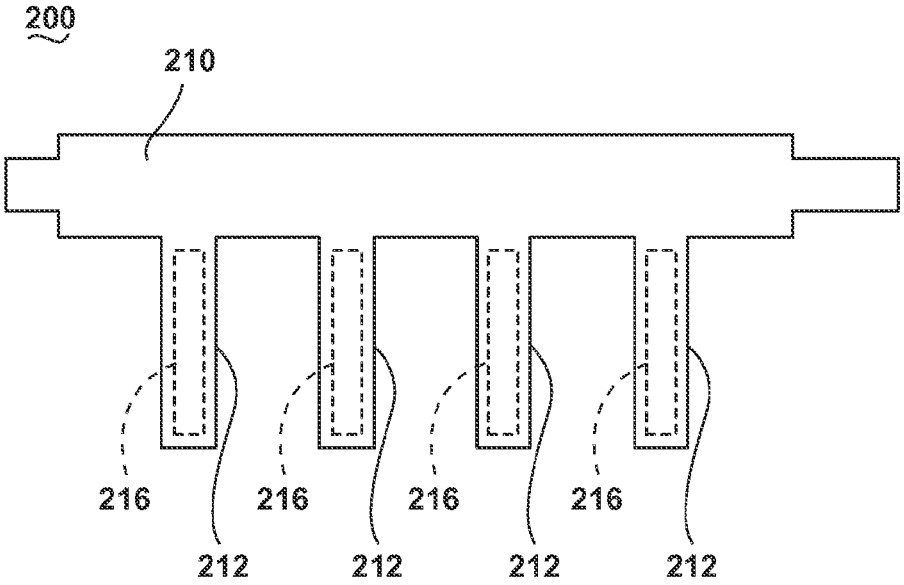
FIG. 7 is a side view of a rake for ice cube removal with an array of force sensors positioned along the fingers of the rake according to an embodiment of the invention.

As shown in FIG. 7, PDE force sensors 216 may be placed on one or more of the fingers 212 of the rake 200. Consequently, the removal force applied to expel each ice cube from a cavity 116 in the ice cube mold 100 may be independently monitored. In this way, one of the PDE force sensors 216 may detect excessive torsion of a particular finger 212 indicative of an ice cube stuck in a cavity 116. By determining the particular cavity 116 where excessive force may be required to expel an ice cube, additional actions may be taken. Mitigating actions may include alerting the user or automatically initiating a cleaning procedure.

Figure 8:
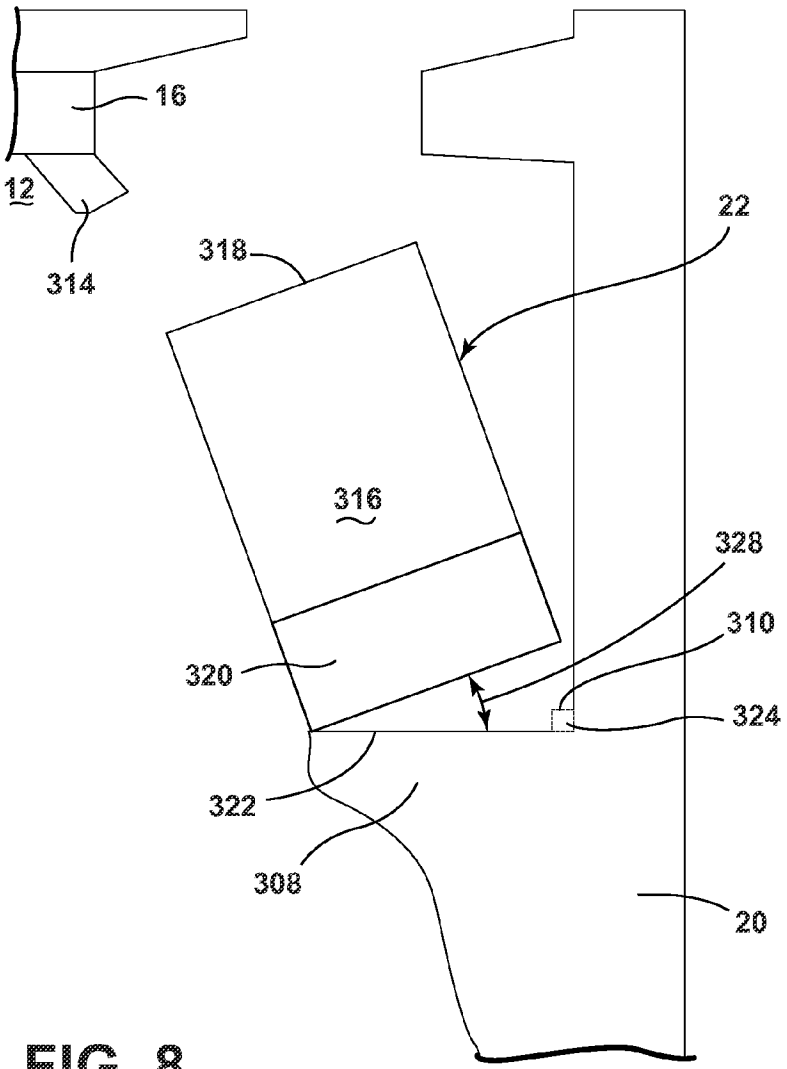
FIG. 8 shows a side view of a portion of refrigerator with a door having a ledge on which the ice storage bin may rest according to an embodiment of the invention.

FIG. 8 shows a side view of a portion of a refrigerator with a door 20 having a ledge 308 on which the ice storage bin 22 may rest and a freezer compartment 12 in which is mounted an ice maker 16. As described above, the ice maker 16 may be a twist ice maker or a rotating rake ice maker. The ice maker 16 may further include an output 314 for expelling ice cubes that is located above the ice storage bin 22. As shown in FIG. 8, the output 314 for expelling ice cubes from the ice maker 16 may be located above and may not overlie the storage bin 22. The storage bin 22 defines an ice cube reservoir 316 that has an opening 318 in communication with the ice maker output 314 for receiving the ice cubes. Preferably, the opening 318 is located at the top of the storage bin 22.

Figure 9:
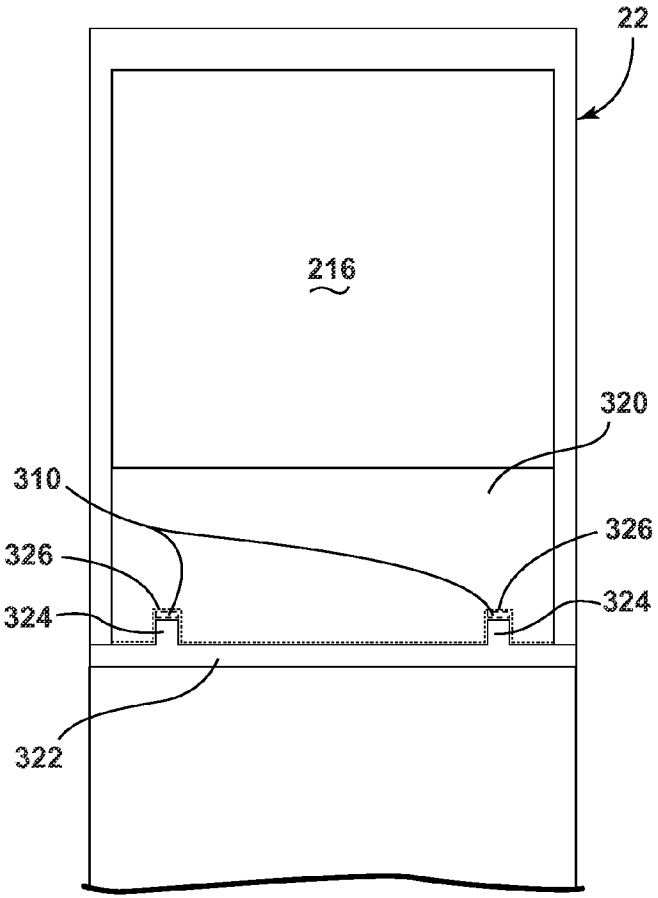
FIG. 9 is a front view of an ice bucket in contact with a force sensor for determining the weight of the ice in the bucket according to an embodiment of the invention.

The base 320 of the ice storage bin 22 may be removably supported on an ice storage bin mounting plate 322. When attached to the ice storage bin mounting plate 322, the ice storage bin 22 is securely connected to the refrigerator 10. As best seen in FIG. 9, mating of protrusions 324 located on the ice storage bin mounting plate 322 with recesses 326 in the base 320 of the ice storage bin 22 may secure the removable connection. The protrusions 324 and corresponding recesses 326 may be provided anywhere along the ice bucket mounting plate 322.

Provided on top of the protrusions 324 and, consequently, below the ice storage bin 22, one or more PDE force sensors 310 may detect the weight of the storage bin 22 including its content when it is placed on the ice storage bin mounting plate 322. The PDE force sensor 310 may experience a level of compression that correlates with the weight placed on it. In this way, the PDE force sensors 310 may output a signal that may be calibrated to indicate the weight of the ice cubes within the ice cube reservoir 316.

Typically, an ice storage bin 22 in a freezer compartment of a refrigerator 10 is designed to maximize the ice cube reservoir 316. That is, the storage bin 22 may assume the maximum dimensions of the space available in the freezer compartment and the ice harvesting process may be configured to produce ice until the ice cube reservoir 316 completely fills the storage bin 22. Consequently, for many consumers, the storage bin 22 may hold an undesirable amount of ice that may become stagnant and malodorous or may sublimate from unuse. To avoid the problem of ice staleness, it may be desirable to limit the amount of ice available based on an individual consumer's preference.

Therefore, to detect the level of ice storage, the controller 104 in communication with the PDE force sensor 310 may monitor the ice level by determining the weight of the ice storage bin 22 with ice cubes in the ice cube reservoir 316. In response to the determined level of ice based on the PDE force sensor output and a user-defined input stating a desired level of ice, the controller may prevent additional ice harvesting by the ice maker 16. The controller 104 may allow for continued ice harvesting once the level of ice storage falls below the consumer's desired level. For example, upon consumption of ice cubes, the PDE force sensor 310 may continue to output a signal to indicate the weight of the ice cubes. Once the weight falls below the value associated with the desired level of ice storage, the controller may signal the ice maker 16 to continue harvesting. Alternatively, the consumer may choose to increase the desired level of ice storage.

In addition to preventing an ice harvesting process when the ice reservoir 316 reaches a desired level of ice cubes, the ice making assembly may be designed to prevent ice harvesting when the storage bin 22 is removed from the refrigerator 10. As shown in FIG. 8, the PDE sensor 310 may detect when the storage bin 22 is not positioned 328 to receive ice cubes. Upon detection of a voltage indicative of little or no weight being applied, the PDE sensor 310 may transmit a signal to the controller 104. The controller 104 may then prevent the ice maker 16 from expelling ice cubes to the storage bin 22.

Depending upon the placement and configuration of the PDE sensor 310 and controller 104, it is contemplated that the PDE sensor 310 may be operated in a wireless configuration. While it is generally known to operate sensors with either a hard-wired or wireless connection, typical wireless sensors require external power sources that require additional wiring to power supplies. As previously described, PDE sensors 310 require very little power for operations. Additionally, PDE devices may be configured to generate power when exposed to mechanical vibrations. That is, PDE devices may scavenge energy from ambient vibrations. For refrigerators, sources of mechanical vibration may include a power cycle of the compressor, placement of the ice storage bin 22 onto the ice storage bin mounting bracket 322, the kinetic energy from harvested ice landing in the ice storage bin 22, the weight of products as they are placed on refrigerator shelves, etc. By either storing scavenged energy into a battery or using power on demand, the PDE sensor 310 may locally source power for operating a wireless connection to the controller 104. The PDE force sensor 310 and the energy scavenging PDE device may be the same device or may be implemented as separate devices. While operating one or more PDE sensors with a power scavenging PDE device may provide a desirable power saving feature, it is noted that a more typical wired connection to enable communication between the PDE sensor 310 and the controller 104 may be implemented.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. An ice maker comprising:

an ice cube mold having at least one cavity for receiving liquid;

an ice cube remover configured to apply a removal force to at least one of the mold and ice cube;

a force sensor comprising a piezo dielectric elastomer (PDE) provided on one of the mold and remover and providing a feedback signal output indicative of the removal force; and a motor functionally coupled with the ice cube remover, the motor having a feedback mechanism based in part on the feedback signal output to control an amount of torque generated by the motor;

wherein upon actuating the motor, the ice cube remover applies a removal force to one of the mold and ice cube to effect the removal of an ice cube from the cavity, the force sensor outputs the feedback signal indicative of the removal force, and the feedback mechanism controls the amount of torque generated by the motor.

2. The ice maker of claim 1 wherein the PDE is provided on the ice cube mold.

3. The ice maker of claim 2 wherein the ice cube remover twists the ice cube mold to apply a removal force in the form of a twisting force to the ice cube mold.

4. The ice maker of claim 3 wherein the ice cube remover twists the ice cube mold about a longitudinal axis of the ice cube mold.

5. The ice maker of claim 4 wherein the PDE is oriented at an angle relative to the longitudinal axis.

6. The ice maker of claim 5 wherein the PDE is located along a side edge of the ice cube mold.

7. The ice maker of claim 1 wherein the ice cube remover comprises a rotating rake to expel the ice cube from the cavity and the PDE is provided on the rake.

8. The ice maker of claim 7 wherein the rake comprises a rotatable shaft and at least one finger extending from the shaft and rotatable through the cavity to expel the ice cube, with the PDE provided on at least one of the shaft and finger.

9. The ice maker of claim 8 wherein the ice cube mold comprises multiple cavities and the rake comprises multiple fingers, with at least one finger corresponding to a cavity.

10. The ice maker of claim 9 wherein the PDE extends along the rotatable shaft for a distance at least as great as two adjacent fingers.

11. The ice maker of claim 9 wherein the PDE extends along at least two of the fingers.

* * * * *